US010157547B2

(12) United States Patent
Farjon

(10) Patent No.: US 10,157,547 B2
(45) Date of Patent: Dec. 18, 2018

(54) METHOD FOR NAVIGATING AN AERIAL DRONE IN THE PRESENCE OF AN INTRUDING AIRCRAFT, AND DRONE FOR IMPLEMENTING SAID METHOD

(71) Applicant: SAFRAN ELECTRONICS & DEFENSE, Boulogne Billancourt (FR)

(72) Inventor: Julien Farjon, Boulogne Billancourt (FR)

(73) Assignee: SAGEM DEFENSE SECURITE, Boulogne Billancourt (FR)

( * ) Notice: Subject to any disclaimer, the term of this patent is extended or adjusted under 35 U.S.C. 154(b) by 127 days.

(21) Appl. No.: 15/310,015

(22) PCT Filed: Apr. 30, 2015

(86) PCT No.: PCT/EP2015/059603
§ 371 (c)(1),
(2) Date: Nov. 9, 2016

(87) PCT Pub. No.: WO2015/173033
PCT Pub. Date: Nov. 19, 2015

(65) Prior Publication Data

US 2017/0178519 A1 Jun. 22, 2017

(30) Foreign Application Priority Data

May 12, 2014 (FR) ..... 14 54215

(51) Int. Cl.
*G08G 5/00* (2006.01)
*G08G 5/04* (2006.01)

(52) U.S. Cl.
CPC ..... *G08G 5/0069* (2013.01); *G08G 5/0078* (2013.01); *G08G 5/045* (2013.01)

(58) Field of Classification Search
CPC ..... G08G 5/0069; G08G 5/0078; G08G 5/045
See application file for complete search history.

(56) References Cited

U.S. PATENT DOCUMENTS

| | | | | |
|---|---|---|---|---|
| 5,581,250 | A * | 12/1996 | Khvilivitzky | G01S 11/12 340/945 |
| 2007/0152099 | A1* | 7/2007 | Moreau | B64D 7/00 244/117 R |
| 2008/0177427 | A1 | 7/2008 | Marty et al. | |
| 2009/0184862 | A1 | 7/2009 | Stayton et al. | |
| 2010/0198514 | A1 | 8/2010 | Miralles | |
| 2010/0231705 | A1 | 9/2010 | Yahav et al. | |

(Continued)

FOREIGN PATENT DOCUMENTS

| | | |
|---|---|---|
| EP | 2600330 | 6/2013 |
| WO | WO 2013164237 | 11/2013 |

*Primary Examiner* — Rodney A Butler
(74) *Attorney, Agent, or Firm* — Muncy, Geissler, Olds & Lowe, P.C.

(57) ABSTRACT

A method of navigation of an aerial drone in the presence of at least one intruding aircraft in an airspace zone surrounding the drone, wherein an estimated distance between the drone and the intruding aircraft is calculated based on a strength of the signal received and validated if an estimated value of an element of positioning data calculated by the drone using the estimated distance substantially corresponds to a measured value of the element of positioning data. An aerial drone designed for implementation of this method.

15 Claims, 1 Drawing Sheet

(56) References Cited

U.S. PATENT DOCUMENTS

| | | | | |
|---|---|---|---|---|
| 2011/0160941 | A1* | 6/2011 | Garrec | G01S 13/913 701/17 |
| 2011/0160950 | A1 | 6/2011 | Naderhirn et al. | |
| 2011/0163908 | A1* | 7/2011 | Andersson | G01S 5/0072 342/36 |
| 2011/0169684 | A1* | 7/2011 | Margolin | G01S 5/12 342/30 |
| 2011/0210872 | A1* | 9/2011 | Molander | G01S 5/16 340/961 |

* cited by examiner

METHOD FOR NAVIGATING AN AERIAL DRONE IN THE PRESENCE OF AN INTRUDING AIRCRAFT, AND DRONE FOR IMPLEMENTING SAID METHOD

BACKGROUND OF THE INVENTION

The present invention relates to the prevention of collisions between aircraft and more particularly to a method of navigation and piloting aerial drones.

The invention also relates to a drone implementing such a method of navigation and piloting.

STATE OF THE ART

An aerial drone is an aircraft without a human pilot on board. This aircraft can be equipped with automated systems and fly autonomously; it may also be equipped with sensors connected to an automatic pilot device and/or a remote-control device operated by a pilot on the ground. Aerial drones are being used increasingly in the military sphere, particularly for surveillance of battlefields and reconnaissance or even ground attack.

Use of aerial drones in the civil sphere has been contemplated, in particular in order to perform operations involving aerial surveillance of territories. These drones are indeed interesting, since they have a high degree of autonomy of flight. On the other hand, they suffer from poor manoeuvrability. The absence of a pilot on board prevents the drone from complying with the rules of the air in force in civil airspace; rules that stipulate in particular that an aircraft must be able to perform a "see-and-avoid" function allowing the latter to avoid a collision. Hence, drones are not allowed to fly in non-segregated airspace, i.e. in the same places and at the same times as civil aircraft with a pilot on board.

It is known to install transponders (operating according to mode A, C or S for civil aircraft) on board aircraft, allowing in particular secondary air traffic control stations to determine the position of these aircrafts and identify the latter in the monitored airspace. To this end, the secondary radar stations interrogate the transponders of the aircrafts operating in the monitored airspace zone and the transponders return in response a signal containing an identifier and also a barometric altitude according to the operating mode of the transponder.

A collision avoidance system exists, designed to equip some piloted aircraft, which is known by the name of TCAS and corresponds to the ACAS standard defined by the Convention on International Civil Aviation. In Europe, use of this system tends to be widespread and all commercial aircraft with more than nineteen passenger seats must be compulsory fitted with version II of this system including a mode S transponder. The system is designed to retrieve data concerning the heading and position of any aircraft, so-called intruding aircraft, operating in the airspace surrounding the aircraft considered as a distance ranging between 2.5 miles (4 km) and 30 miles (48 km). These data mainly comprise the distance from these aircraft, their barometric altitudes and approximate azimuth. The data are recovered by interrogating the mode S transponder of the intruding aircraft and are used by the TCAS II system to determine whether collision with this intruding aircraft is possible. If potential collision is detected by the TCAS system, the pilot of each aircraft is informed by an audible alarm emitted within the cockpit. If the risk of collision is not reduced following this alarm and the collision seems imminent, the TCAS system determines an instruction to manoeuvre for the pilot: maintain existing flightpath, climb, descend or monitor vertical speed.

Use of the TCAS II system is however restrictive and inappropriate on drones, which do not have a pilot on board and are generally relatively low cost.

AIM OF THE INVENTION

An aim of the invention is to facilitate navigation of a drone and increase the latter's safety by making it possible to take account of at least one intruding aircraft in the airspace surrounding the drone.

BRIEF SUMMARY OF THE INVENTION

To this effect, the invention provides for a method of navigation of an aerial drone in the presence of at least one intruding aircraft in an airspace zone surrounding the drone. The method comprises the stages, implemented on the drone, involving:

- receiving a signal from the intruding aircraft, which signal comprises at least the altitude of the intruding aircraft and calculating an estimated distance between the drone and the intruding aircraft based on a strength of the received signal;
- capturing at least one image of the intruding aircraft and determining a bearing angle of the intruding aircraft based on this image;
- extracting from the signal the altitude transmitted by the intruding aircraft;
- calculating, using the estimated distance, an estimated value of an element of positioning data of the intruding aircraft or the drone;
- comparing the estimated value of the element of positioning data with a measured value of the element of positioning data and taking account of the distance calculated for navigation if the estimated value substantially matches the measured value.

The element of positioning data may be the altitude of the intruding aircraft (wherein the measured value is the transmitted altitude) or the bearing angle of the intruding aircraft in relation to the drone (wherein the measured value of the bearing angle is that determined in the image). Hence, since the estimated distance is involved in calculating the estimated value of the element of positioning data, comparison of the estimated value and the measured value allows verification of the validity of the estimated distance between the drone and the intruding aircraft. This therefore limits the risk of error. The estimated and validated distance can subsequently be taken into account in navigation, particularly in order to predict evasive action by the intruding aircraft or identify among the available data those which are safest to use for navigation. It is not mandatory that the drone be equipped with a transponder interrogator, with the receiver on board the drone receiving for example the signals emitted by the mode C or S transponder of the intruding aircraft after it has been interrogated either by the secondary radar on the ground or by another aircraft equipped with an interrogator; the receiver on board the drone may also receive for example the signals emitted automatically by an ADS-B (Automatic Dependent Surveillance-Broadcast) device. The method of the invention can therefore be implemented based on only passive sensors, particularly if the drone is solely required to operate in an environment covered by secondary radars.

The invention also relates to a drone comprising a piloting device connected to an altitude measuring instrument, an optronic detection device designed to determine a bearing angle of an intruding aircraft operating in an area surrounding the drone and to a receiver for receiving a signal that is emitted by an intruding aircraft and which includes an altitude of the intruding aircraft. The piloting device of the drone is designed to:

- calculate an estimated distance between the drone and an intruding aircraft based on a strength of a signal received by the receiver;
- capture at least one image of the intruding aircraft by the optronic device and determine the bearing angle of the intruding aircraft based on this image;
- extract from the signal the altitude transmitted by the intruding aircraft;
- calculate an estimated altitude of the intruding aircraft based on the bearing angle and the calculated distance;
- compare the estimated altitude with the transmitted altitude and take account of the distance calculated for navigation if the estimated altitude substantially matches the transmitted altitude.

Other characteristics and advantages of the invention will become apparent upon reading the following description of particular non-restrictive embodiments of the invention.

BRIEF DESCRIPTION OF THE SEVERAL VIEWS OF THE DRAWING (S)

Reference is made to the appended drawings, wherein.

DETAILED DESCRIPTION OF THE INVENTION

Figure 1:
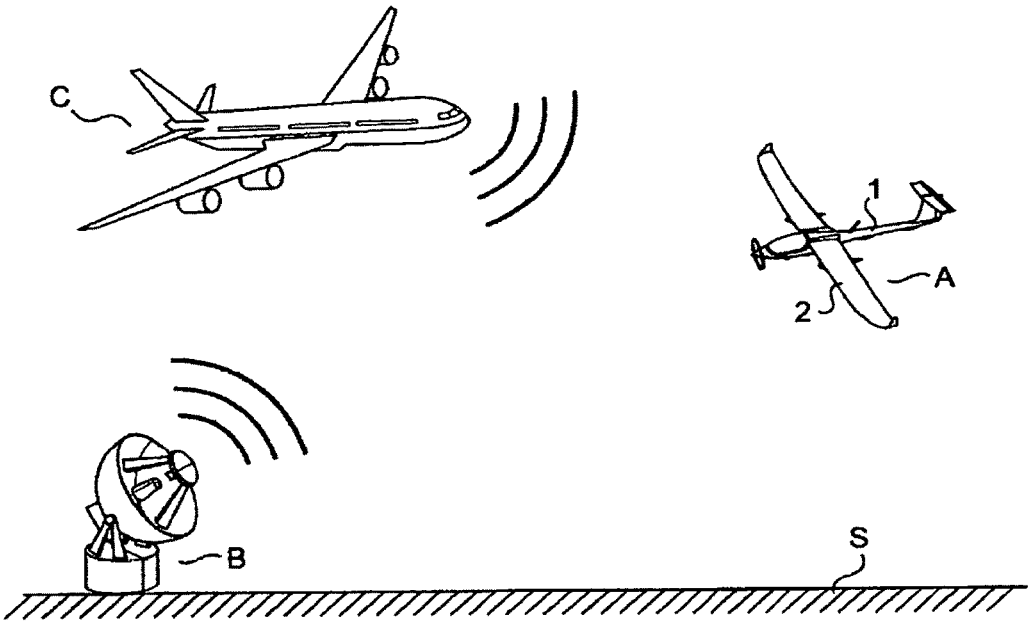
FIG. 1 is a schematic view, in perspective, of situation of intersection between an aircraft and a drone according to the invention.
Figure 2:
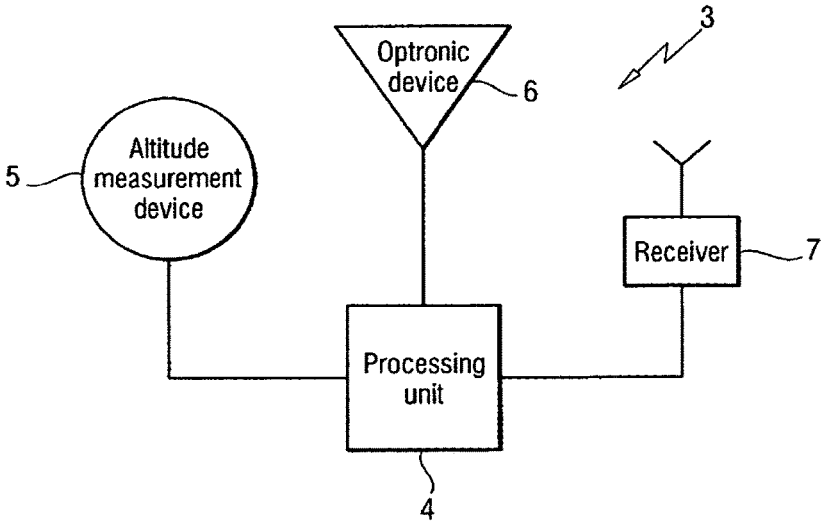
FIG. 2 is a schematic view of the piloting device of the drone according to the invention.

Referring to the figures, the aerial drone according to the invention has the overall shape of an aircraft and comprises a fuselage 1 and wings 2 which are equipped with flying surfaces movable by means of actuators connected to a piloting device on board the drone. The drone structure itself is not part of the invention and will therefore not be described in detail here.

The piloting device, generally referred to in 3, comprises a data processing unit 4 connected to an altitude measuring instrument 5, an optronic detection device 6 and a receiver 7. The piloting device 3 also comprises in a manner known per se means of control of the actuators of the flight control surfaces and the drone engine.

The data processing unit 4 is a computer unit comprising in particular a processor for processing the data and a memory for recording the data.

The altitude measuring instrument 5 is a conventional barometric instrument.

The optronic detection device 6 comprises an image sensor connected to an acquisition unit and oriented in order to obtain a field covering a monitored airspace zone situated in front of the drone. The sensor of the detection device 6 is designed to function in the infrared range and/or in the visible range. The performances of the sensor are adequate in order to allow detection, in the images provided, of an aircraft (so-called intruding aircraft) located within the monitored airspace zone at a maximum distance of between 8 and 10 km. The processing unit 4 includes an image processing module (software or hardware) designed to determine a bearing angle of the intruding aircraft operating within the monitored airspace zone.

The receiver 7 has a directional antenna and is designed to receive a signal emitted by the mode S transponders of the aircrafts operating in the vicinity of the drone. The receiver operates in this case at a frequency of 1090 MHz. The signal contains: a barometric altitude of the intruding aircraft, a carrier code and a hexadecimal code identifying each aircraft equipped with a mode S transponder.

The piloting device 3 is designed and programmed in order to:

- calculate an estimated distance between the drone and an intruding aircraft based on a strength of a signal received by the receiver 7;
- capture at least one image of the intruding aircraft by the optronic device 6 and determine the bearing angle of the intruding aircraft based on this image;
- extract from the signal the altitude transmitted by the intruding aircraft;
- calculate an estimated altitude of the intruding aircraft based on the bearing angle and the calculated distance;
- compare the estimated altitude with the transmitted altitude and take account of the distance calculated for navigation if the estimated altitude substantially matches the transmitted altitude.

The processing unit 4 is programmed in order to employ Kalman filters for calculation in particular of:

- an altitude and vertical speed of the intruding aircraft based on the transmitted altitude contained in the signals received;
- an estimated distance and a relative speed (or closing speed) between the drone and the intruding aircraft based on the strength of each received signal;
- an estimated altitude and an estimated elevation speed of the intruding aircraft based on the bearing angle and the estimated distance.

The processing unit 4 furthermore includes an association module (software or hardware) for associating data solely derived from the received signal (transmitted altitude, estimated distance, estimated closing speed, vertical speed) and data also derived from the images (estimated elevation speed, estimated altitude).

A situation involving a potential collision between a drone in accordance with the invention and an intruding aircraft will now be described in order to explain the method of the invention.

When the drone A is flying, the optronic device 6 supplies images to the processing unit 4 which processes these images in order to seek the presence of an intruding aircraft. As soon as an intruding aircraft C is detected by the image processing module in one of the images transmitted by the optronic device 6, the image processing module subsequently determines in the image a bearing angle of the intruding aircraft C appearing in the image.

In parallel, the drone A in flight receives signals from the transponders of the aircrafts replying to a secondary radar station B that is located on the ground S and has a surveillance zone within which said aircrafts are flying in addition to the drone A. The processing unit 4 of the drone A extracts the transmitted altitude contained in the signal, the identifier of the aircraft that emitted the signal and the power of the received signal.

The estimated distance between the drone and the intruding aircraft is calculated by the Kalman filter based on the power of the received signal and is transmitted to the association module.

The estimated distance is also used by the processing unit 4 to calculate an estimated altitude of the intruding aircraft based on the estimated distance and the bearing angle.

It goes without saying that calculation of the estimated distance is only valid if signal reception and image capture are close together in time. It may thus be envisaged that the piloting unit 3 is designed to control the optronic device 6 such that reception of a signal automatically triggers capture of an image by the optronic device 6.

The estimated altitude is calculated in the local terrestrial frame (for example in the NED or ENU coordinate system). Once again, the accuracy of the estimated altitude depends on the proximity in time of signal reception and image capture.

The power of the received signal is used here in the form of the signal-to-noise ratio of the received signal. This ratio depends on the distance between the transponder and the receiver, on the output power (transponder of between 1 to 5 watts TBC), on the gain of the transmitting antenna (transponder antenna of the intruding aircraft C), on the gain of the receiving antenna 7 and on the atmospheric attenuation. Nevertheless, it has been possible to determine experimentally that the distance can be approximated by a second-degree law of the signal to noise ratio. The law adopted is valid over the distance range considered, in this case between 1 and 10 km.

Assuming that it has been possible to establish an association with a transmitted identifier, the data that will be extracted from images of the intruding aircraft C or signals subsequently transmitted by the intruding aircraft C will be associated with said identifier.

Based on the data obtained from both successive signals, the Kalman filters of the processing unit 4 are designed to calculate, based on the estimated distances, a closing distance of the intruding aircraft C and the drone A and an estimated time to collision between the intruding aircraft C and the drone A.

The Kalman filters are designed to monitor evolution of the data over time, detect errors and smooth the results.

The transmitted altitudes, estimated distances, estimated closing speeds (calculated by differences in the estimated distances over a given time), vertical speeds (calculated by the difference in the altitudes transmitted over a given time), the estimated altitudes (calculated based on the estimated distances and the bearing angles) and the estimated elevation speeds are transmitted to the association module of the processing unit 4 which is designed to associate these data with an identification code of the data such as the identifier of the intruding aircraft (transmitted in the received signal).

Hence, the association module is designed to perform a comparison of altitudes, i.e.:

- a direct comparison of the altitudes (transmitted altitude and estimated altitude of the intruding aircraft); and/or
- a comparison of the elevation speeds (obtained by the difference in the successively transmitted altitudes and by the difference in the altitudes estimated based on the two successive images, respectively in relation to the time between the receptions of the successive signals and the time between the captures of the successive images).

Based on the estimated time to collision, the processing unit 4 issues the piloting device 3 an avoidance command; the avoidance command may be systematically the same (veer to the right or veer to the left) or be adapted for example taking account of the elevation speed of the intruding aircraft C (ascent or descent).

It can therefore be seen that the validated estimated distance has been taken into account in navigation of the drone A.

It will be noted that the association module adopts as identifier that for which the estimated altitude is substantially equal to the transmitted altitude (whereby the estimated distance is validated in this case). In the event that several identifiers could be selected, the association module adopts as the identifier that which corresponds to the worst case, i.e. that resulting in the shortest estimated distance and the highest closing speed.

If no transmitted altitude is substantially equal to the estimated altitude, the selected identification code is specific to the association module until the data associated with this identification code can be associated with a transmitted identifier and with the data associated with the latter.

The identification code is thus either specific to the association mode if a signal has not yet been received or to the identifier extracted from the received signal if such as signal has been received.

It will also be noted that the directional antenna makes it possible to eliminate ambiguities during association by allowing determination of a direction of emission of the signal and verification of its compatibility with the bearing angle determined in the image. In this case, it would also be of value to extract from the images an elevation angle, the consistency of which with the direction of emission can subsequently be verified. Furthermore, the elevation angle can be used to determine a flightpath of the intruding aircraft in order to develop an avoidance manoeuvre and/or fine-tune the prediction of collision.

The processing unit 4 is furthermore preferably designed to determine the closing speed of the intruding aircraft based on a dimension of the intruding aircraft in two successive images captured by the optronic device. To this end, the image processing module extracts from each image a solid angle formed by the surface of the intruding aircraft in each image or the size in pixels of the intruding aircraft in each image. By comparison with signatures contained in an aircraft signature database, an estimated distance between the drone and the intruding aircraft can be determined (a size of the intruding aircraft obtained from data contained in the mode S signal may also be used as a guide). The processing unit 4 is designed to provide closing speeds periodically based on the variation in the solid angle or size in pixels of the intruding aircraft obtained by comparison of these data from two successive images.

Thus, in the absence of a transponder on the intruding aircraft, only the data extracted from the images provided by the optronic detection device are used to determine the risk of collision and the avoidance manoeuvre to be carried out.

Furthermore, if the intruding aircraft is equipped with a transponder, the closing speeds obtained by image processing can be compared with those obtained as a function of the variation in the estimated distance calculated as a function of the strength of the received signals. This allows validation or correction of the results provided by the association module. It is therefore possible to compare and analyse the results obtained by using only the data derived from the optronic device 6 and the results obtained by also using the data extracted from the signals so as to only keep the results with less noise.

As an alternative embodiment, the processing unit 4 is also connected to an interrogator designed to interrogate the transponders of the aircraft operating in the vicinity.

Of course, the invention is not limited to the described embodiments but encompasses any alternative solution within the scope of the invention as defined in the claims.

In particular, the invention can be used with transponders operating according to modes other than mode S, for instance mode C or the modes of the transponders of military aircraft. If the signal does not have an identifier, the data consistent with the signal received are sought in order to identify the corresponding track.

The invention can also be used with the Automatic Dependent Surveillance-Broadcast system ADS-B in which the intruding aircraft periodically emits omnidirectionally a signal containing in particular its position and altitude.

As an alternative embodiment, the element of positioning data is the bearing angle of the intruding aircraft, wherein the method therefore comprises the stages of:

calculating an estimated bearing angle of the intruding aircraft based on the altitude of the drone, the transmitted altitude and the estimated distance;

comparing the estimated bearing angle with the bearing angle determined based on the image and taking account of the estimated distance for navigation if the estimated bearing angle substantially matches the bearing angle determined based on the image.

The processing unit can be designed to extract data from the image other than those mentioned, for example an elevation angle of the intruding aircraft. This elevation angle is not used in the method described, as it is considered that the intruding aircraft is heading directly towards the drone in order to take account of the most critical situation in navigation of the drone. One could contemplate using the elevation angle to determine a flightpath of the intruding aircraft in order to fine-tune the prediction of collision and the avoidance manoeuvre to be carried out.

The altitudes used may be barometric altitudes and/or altitudes obtained by a satellite-type geo-location device.

The invention claimed is:

1. A method of navigation of an aerial drone in the presence of at least one intruding aircraft in an airspace zone surrounding the drone, characterised in that the method comprises the stages, implemented via a piloting device, mounted on the drone, involving:

receiving via the piloting device, mounted on the drone a signal from the intruding aircraft, which signal comprises at least the altitude of the intruding aircraft and calculating an estimated distance between the drone and the intruding aircraft based on a strength of the received signal;

capturing via an optronic device associated with the piloting device, at least one image of the intruding aircraft and determining a bearing angle of the intruding aircraft based on this image;

extracting from the signal the altitude transmitted by the intruding aircraft;

calculating, using the estimated distance, an estimated value of an element of positioning data of the intruding aircraft or the drone;

comparing the estimated value of the element of positioning data with a measured value of the element of positioning data and taking account of the distance calculated for navigation if the estimated value substantially matches the measured value; and commanding the aerial drone using the calculated distance.

2. The method according to claim 1, wherein the element of positioning data is the altitude of the intruding aircraft, said method therefore comprising the stages of:

calculating an estimated altitude of the intruding aircraft based on the bearing angle and the estimated distance;

comparing the estimated altitude with the transmitted altitude and taking account of the estimated distance for navigation if the estimated altitude substantially matches the transmitted altitude.

3. The method according to claim 1, wherein the element of positioning data is the bearing angle of the intruding aircraft, said method therefore comprising the stages of:

calculating an estimated bearing angle of the intruding aircraft based on the altitude of the drone, the transmitted altitude and the estimated distance;

comparing the estimated bearing angle with the bearing angle determined based on the image and taking account of the estimated distance for navigation if the estimated bearing angle substantially matches the bearing angle determined based on the image.

4. The method according to claim 1, comprising the subsequent stage of calculating at least one closing speed of the drone and of the intruding aircraft and an estimated time to collision based on the estimated distance calculated on two successive images.

5. The method according to claim 4, comprising the stages of calculating a closing speed of the drone and of the intruding aircraft based on a dimension of the intruding aircraft in two successive images and comparing the closing speed determined based on a dimension of the intruding aircraft in two successive images and the closing speed determined based on the estimated distance calculated in two successive images.

6. An aerial drone comprising a piloting device including a data processing unit connected to an altitude measuring instrument, to an optronic detection device designed to determine a bearing angle of an intruding aircraft operating in an area surrounding the drone and to a receiver for receiving a signal that is emitted by the intruding aircraft and which includes an altitude of the intruding aircraft, wherein the piloting device is designed to:

calculate an estimated distance between the drone and the intruding aircraft based on a strength of a signal received by the receiver;

capture at least one image of the intruding aircraft by the optronic device and determine the bearing angle of the intruding aircraft based on this image;

extract from the signal the altitude transmitted by the intruding aircraft;

calculate, using the estimated distance, an estimated value of an element of positioning data of the intruding aircraft or the drone;

compare the estimated value of the element of positioning data with a measured value of the element of positioning data and taking account of the distance calculated for navigation if the estimated value substantially matches the measured value; and command the aerial drone using the calculated distance.

7. The drone according to claim 6, comprising an interrogator designed to interrogate a transponder of the intruding aircraft.

8. The drone according to claim 6, wherein the data processing unit comprises a device for means of estimating a closing speed of the intruding aircraft.

9. The drone according to claim 8, wherein the device for estimating is an image processing unit designed to determine the closing speed of the intruding aircraft as a function of a size of the intruding aircraft in two successive images captured by the optronic device.

10. The drone according to claim 8, wherein the device for estimating comprises a Kalman filter for calculating the closing speed based on the estimated distances.

11. The drone according to claim 10, wherein the Kalman filter is designed to provide periodically estimated distances and closing speeds based on the images provided by the optronic device and the altitude transmitted by the aircraft.

12. The drone according to claim 11, wherein the estimated distances and the closing speeds are associated with an identifier of the intruding aircraft, said identifier being extracted from the signal received by drone transponder.

13. The drone according to claim 6, wherein the receiver comprises a directional antenna.

14. The drone according to claim 6, wherein the element of positioning data is the altitude transmitted by the intruding aircraft.

15. The drone according to claim 6, wherein the element of positioning data is the bearing angle of the intruding aircraft.

* * * * *